US005119882A

United States Patent [19]

Corbett

[11] Patent Number: 5,119,882

[45] Date of Patent: * Jun. 9, 1992

[54] EVAPORABLE FOAM PATTERN FOR CASTING AN ENGINE BLOCK FOR A TWO-CYCLE ENGINE HAVING A DIRECT CHARGE SYSTEM

[75] Inventor: William D. Corbett, Fond du Lac, Wis.

[73] Assignee: Brunswick Corporation, Skokie, Ill.

[ * ] Notice: The portion of the term of this patent subsequent to Feb. 18, 2009 has been disclaimed.

[21] Appl. No.: 599,705

[22] Filed: Oct. 18, 1990

[51] Int. Cl.[5] ..... B22C 9/04

[52] U.S. Cl. ..... 164/246; 164/34; 164/45

[58] Field of Search ..... 164/34, 35, 45, 235, 164/246, 249

[56] References Cited

U.S. PATENT DOCUMENTS

| | | | |
|---|---|---|---|
| 4,632,169 | 12/1986 | Osborn et al. | 164/45 |
| 4,640,333 | 2/1987 | Martin et al. | 164/246 |
| 4,657,063 | 4/1987 | Morris | 164/45 |
| 4,777,997 | 10/1988 | Corbett | 164/246 |
| 4,802,447 | 1/1989 | Corbett | 164/45 |
| 4,883,110 | 11/1989 | Morgan et al. | 164/249 |
| 4,907,638 | 3/1990 | Hubbell et al. | 164/45 |
| 4,951,733 | 8/1990 | Kusche et al. | 164/246 |

FOREIGN PATENT DOCUMENTS

| | | |
|---|---|---|
| 62-282744 | 12/1987 | Japan . |
| 62-282745 | 12/1987 | Japan . |
| 62-282746 | 12/1987 | Japan . |
| 62-282747 | 12/1987 | Japan . |
| 62-282763 | 12/1987 | Japan . |

OTHER PUBLICATIONS

"Evaporative Foam Casting Technology II Program", Nov. 1986.

*Primary Examiner*—Kuang Y. Lin

*Attorney, Agent, or Firm*—Andrus, Sceales, Starke & Sawall

[57] ABSTRACT

An evaporable foam pattern for casting a metal engine block for a two-cycle engine having a direct charge system. The pattern includes a block pattern section having a head end and a crankcase end and a plurality of cylinders extend between the ends. A transfer passage is associated with each cylinder and one end of each transfer passage communicates with the crank-case end of the block, while the opposite end of the transfer passage communicates with the cylinder adjacent the head end. The block pattern section is provided with a plurality of openings each of which provides communication between a transfer passage and the exterior and the openings are bordered by a generally planar surface. The pattern also includes a cover pattern section enclosing the openings in the first section. The cover pattern section has a peripheral flange disposed in abutting relation with the planar surface of the block pattern section and the cover pattern section includes a plurality of inwardly facing portions, each of which is received within an opening in the block section and defines the outer wall of a transfer passage. The abutting surfaces are joined together by an adhesive.

9 Claims, 1 Drawing Sheet

EVAPORABLE FOAM PATTERN FOR CASTING AN ENGINE BLOCK FOR A TWO-CYCLE ENGINE HAVING A DIRECT CHARGE SYSTEM

BACKGROUND OF THE INVENTION

A typical two-cycle internal combustion engine includes a cast metal engine block defining a plurality of cylinders. With a cross flow or direct charge system, a transfer passage is associated with each cylinder and extends from the crankcase end of the block to the upper end of the respective cylinder and a pair of transfer ports provide communication between each transfer passage and the cylinder. During operation, the fuel/air charge is drawn through the transfer passage and enters the cylinder through the two intake ports. The split charge converges and is directed upwardly by a curved deflector on the piston. The converging charges travel in a course to the top of the combustion chamber and then down the sloping side of the deflector to remove the spent gases from the previous power stroke through exhaust ports.

The conventional two-cycle engine block utilizing a cross flow charge system is cast with a series of openings, each of which extends through the wall of the block and communicates with a cylinder, and a separately cast metal port cover is connected to the block and encloses the openings. The inner surface of the port cover defines the outer walls of the transfer passages.

To assemble the port cover with the cast block, the mating surfaces on the cover and block must be machined and holes are drilled in the cover and block and tapped. The mating surfaces are then gasketed and secured together by bolts. The assembly procedure involves a substantial labor and material cost. Further, in order to provide adequate gasketing, the mating surfaces of the port cover and the block must have a substantial width or section, and this increases the overall weight of the block.

Evaporable foam patterns made of polymeric material, such as polystyrene, have been used in the past to cast metal components of internal combustion engines. In the evaporable foam casting process, a pattern is fabricated from the polymeric material and has a configuration conforming to the metal part to be cast. The pattern is then placed in a mold and the area around the pattern, as well as the cavities in the pattern, are filled with an unbonded flowable material, such as sand. Molten metal is introduced to the pattern via a sprue and the heat of the molten metal will vaporize the foam material, with the vapor being entrapped within the interstices of the sand, while the molten metal will occupy the void created by vaporization of the foam pattern to provide a cast metal part having a configuration conforming to the configuration of the pattern.

Summary of the Invention

The invention is directed to an evaporable foam pattern used in casting a metal block for a two-cycle engine and in particular to an engine having a direct charge or cross-flow system. The pattern includes a block pattern section formed of an evaporable foam polymeric material, such as polystyrene, and having a crankcase end and a head end. A plurality of cylinders extend between the ends. A transfer passage is associated with each cylinder and one end of each transfer passage communicates with the crankcase end of the block, while the second end communicates through a pair of intake ports with the cylinder adjacent the head end.

The block pattern section is also formed with a plurality of side-by-side openings, each of which communicates with a transfer passage of a cylinder and the outer surface of the block pattern section bordering the openings is generally flat or planar.

The pattern also includes a cover pattern section which encloses the openings in the block section. The cover section is formed with a peripheral surface which is disposed in abutting flatwise relation with the planar surface on the block section. In addition, the cover section is formed with a plurality of inwardly facing, contoured surfaces, each of which is received within an opening in the block section and defines an outer wall of the respective transfer passage.

The abutting surfaces between the block section and the cover section are joined by an adhesive of the type commonly used in evaporable foam casting processes.

To cast the engine block, the assembled pattern is placed in a mold which is filled with an unbonded, flowable, finely divided material, such as sand. The sand not only surrounds the pattern, but also will fill the cavities in the pattern. An evaporable foam sprue is connected to the pattern and as the molten metal is fed through the sprue it will vaporize the polymeric material of the sprue and the pattern with the vapor being entrapped within the interstices of the sand, while the molten metal will fill the void created by vaporization of the foam to provide a cast engine block conforming in configuration to the evaporable foam pattern.

Through use of the evaporable foam pattern of the invention, the port cover is cast integrally with the engine block, thus eliminating the labor and cost of machining mating surfaces on the port cover and engine block, drilling and tapping holes, and assembling and gasketing the cover to the engine block, as required in the past.

The weight of the engine block is also be reduced because it is not necessary to utilize surfaces of increased width in order to accommodate the gasketing. The elimination of bolts, bosses, and other components required for the mechanical connection of the cover to the block further reduces the overall weight of the engine block.

In normal practice, the internal and external surfaces of the polymeric foam pattern are coated with a ceramic wash and the pattern of the invention is designed so that the wash will freely enter and coat both the internal and external surfaces of the pattern and will fully drain therefrom.

The use of the polymeric foam pattern also produces a smoother finish on the outer surface of the casting, as compared to sand casting, and thereby provides a more attractive appearance for the cast part.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
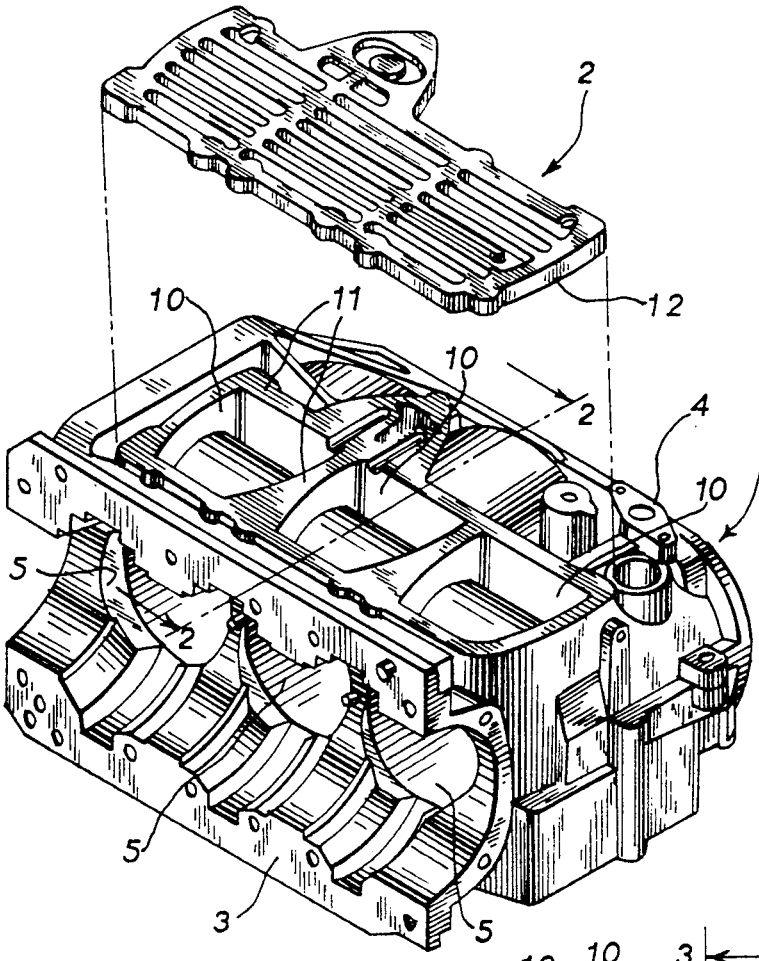
FIG. 1 is a perspective exploded view showing the evaporable foam pattern of the invention.

The invention is directed to an evaporable foam pattern to be used in casting a metal block for a two-cycle engine and particularly a two-cycle engine having a direct or cross-flow charge system. The pattern includes a block section 1 and a port cover section 2. The sections 1 and 2 are composed of a polymeric material, such as polystyrene or polymethylmethacrylate, which is capable of vaporizing when subjected to the heat of molten metal during casting.

Block section 1 includes a crankcase end 3 and a head end 4, and a plurality of cylinders 5 extend between the crankcase end and the head end. Each cylinder is bordered by a generally cylindrical internal wall 6. While the drawings illustrate the invention as applied to a pattern for casting a three-cylinder engine, it is contemplated that the engine can have any number of cylinders.

A transfer passage 7 is associated with each cylinder 5. The inlet 8 of each transfer passage communicates with the crankcase end 3, while the opposite end of the transfer passage communicates through a pair of intake ports 9 with the respective cylinder 5. During operation of the engine, the fuel-air charge travels from the crankcase through the transfer passage 7 and enters the cylinder 5 through the two intake ports 9.

As illustrated in FIG. 1, block section 1 is formed with a plurality of openings or recesses 10, each of which communicates with a transfer passage 7. Block section 1 is provided with a generally flat or planar surface 11 which borders the openings 10, as seen in FIG. 1.

Port cover section 2 encloses the openings 10 and includes a peripheral flange 12 which is disposed in flatwise abutting relation with the surface 11 on block section 1.

In addition, cover section 2 is formed with a plurality of spaced, inwardly facing portions 13, each of which is received within a respective opening 10. The inner surface 14 of each portion 13 defines the outer wall of the respective transfer passage 7, as seen in FIG. 2.

Figure 2:
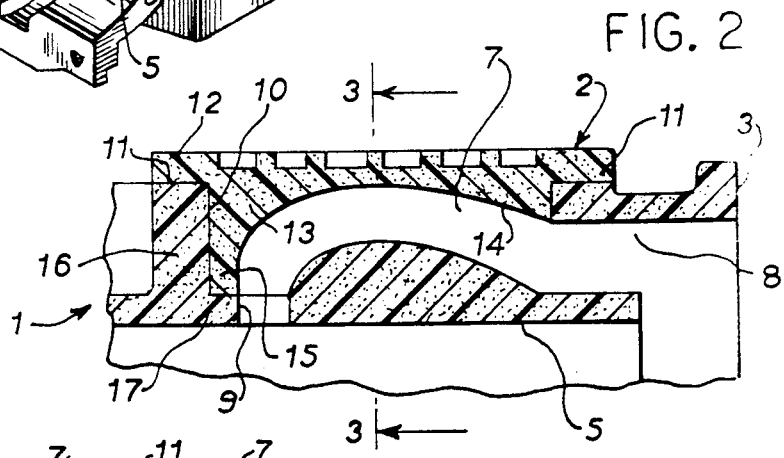
FIG. 2 is a fragmentary longitudinal section showing the attachment of the port cover section to the block section.
Figure 3:
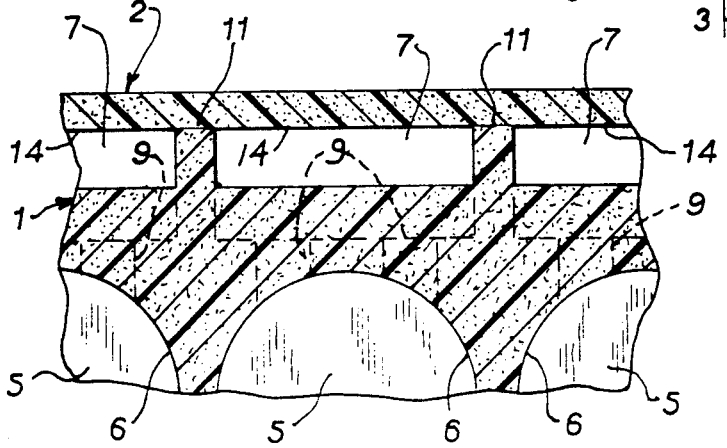
FIG. 3 is a section taken along line 3—3 of FIG. 2.

Each portion 13, as illustrated in FIG. 2 has an inwardly extending flange 15 which is located inwardly of flange 16 on block section 1. The inner end of flange 15 abuts the wall 17 on the block section.

The abutting surfaces of the block section 1 and cover section 2 are joined together by an adhesive of the type commonly used in evaporable foam casting processes. The adhesive is a type that will be vaporized when exposed to the heat of the molten metal with the vapor passing into the surrounding sand, so that no adhesive residue will be present in the metal casting.

The outer surface of cover section 2 can be provided with a plurality of recesses 18 which act to reduce the weight of the cast metal block.

The assembled pattern is subjected to a ceramic wash to coat both the internal and external surfaces of the pattern. The pattern is designed so that the wash will readily contact all of the internal and external surfaces and will drain therefrom.

To cast the block, the ceramic coated pattern is placed in a mold and an unbonded, finely divided material, such as sand, is introduced into the mold surrounding the pattern, as well as filling the cavities in the pattern.

A molten metal, such as an aluminum alloy, is then fed via a sprue into contact with the pattern, and the heat of the molten metal will vaporize the pattern, as well as the adhesive joints, with the vapor passing into the interstices of the sand, while the molten metal fills the void created by vaporization of the pattern. The resulting metal casting has a configuration identical to the evaporable foam pattern.

With a two-cycle engine utilizing a direct charge system, proper flow of the fuel-air charge through the transfer passage to the cylinder is of prime importance. With the invention, the outer surface of the transfer passage, including the critical discharge end adjacent transfer ports 9, is defined solely by the cover section 2, so that there are no parting lines between polymeric pattern sections in this area. This ensures that the outer wall of the transfer passage in the cast block will be smooth and free of obstructions or beads which could adversely effect the flow of the charge through the transfer passage.

The invention enables the port cover to be cast integrally with the block, thus eliminating the requirement for machining abutting surfaces, drilling and tapping holes, and gasketing, as required in an engine construction utilizing a separate cast port cover.

Further, the weight of the engine is reduced because the need for increased section thicknesses to accommodate gasketing is eliminated, as well as eliminating the deadweight of connecting components, such as bolts, bosses, gaskets, and the like.

Various modes of carrying out the invention are contemplated as being within the scope of the following claims particularly pointing out and distinctly claiming the subject matter which is regarded as the invention.

I claim:

1. An evaporable foam pattern for casting an engine block for a two-cycle engine having a direct charge system, comprising a block pattern section formed of evaporable foam material and having a head end and a crankcase end and having a plurality of cylinders extending between said ends, each cylinder being bordered by a generally cylindrical internal wall, said block section also having a transfer passage associated with each cylinder, a first end of each transfer passage communicating with said crankcase end and a second end of each transfer passage communicating with the respective cylinder adjacent the head end, said block section having a plurality of openings each communicating between a transfer passage and the exterior, said openings being bordered by an outer surface, a cover pattern section formed of polymeric material and enclosing said openings, said cover section having a peripheral surface disposed in abutting relation with said outer surface and having a plurality of inwardly facing spaced portions each received within one of said openings and each defining the outer surface of a respective transfer passage, and joining means for joining said abutting surfaces.

2. The pattern of claim 1, wherein each inwardly facing portion extends continuously from the second end of the transfer passage to a location adjacent the first end of the transfer passage.

3. The pattern of claim 1, wherein said joining means comprises an adhesive.

4. The pattern of claim 1, wherein each internal cylindrical wall is provided with a pair of intake ports communicating with the second end of the respective transfer passage.

5. An evaporable foam pattern for casting an engine block for a two cycle engine having a direct charge system, comprising a block pattern section formed of evaporable foam material and having a head end and a crankcase end and having a plurality of cylinders extending between said ends, each cylinder being bordered by a generally cylindrical internal wall, said block section having a plurality of spaced side-by-side recesses bordered by an outer surface, each recess having an outwardly facing bottom wall, first aperture means providing communication between one end of each recess and said crankcase end, second aperture means providing communication between a second end of each recess and the respective cylinder adjacent said head end, a cover pattern section formed of polymeric material and enclosing said recesses, said cover section including a peripheral surface disposed in abutting relation with said outer surface, said cover section including a plurality of spaced portions each disposed within one of said recesses, each portion having an inwardly facing wall spaced from the bottom surface of the respective recess with the space defining a transfer passage, and adhesive means joining the abutting surfaces.

6. The pattern of claim 5, wherein each portion extends continuously from said second aperture means to a location adjacent said first aperture means.

7. The pattern of claim 5, wherein said second aperture means comprises a pair of intake ports.

8. The pattern of claim 5, wherein the polymeric material is polystyrene.

9. The pattern of claim 5, wherein the inwardly facing wall of each portion is inwardly concave.

* * * * *